US006557652B2

(12) United States Patent
Klemm

(10) Patent No.: US 6,557,652 B2
(45) Date of Patent: May 6, 2003

(54) METHOD FOR PERFORMING GROUND OR ROCK WORK AND HYDRAULIC PERCUSSION DEVICE

(76) Inventor: Guenter Klemm, Gray 21, 9572 Deutsch-Griffen (AT)

( * ) Notice: Subject to any disclaimer, the term of this patent is extended or adjusted under 35 U.S.C. 154(b) by 8 days.

(21) Appl. No.: 09/854,460

(22) Filed: May 15, 2001

(65) Prior Publication Data

US 2002/0008420 A1 Jan. 24, 2002

(30) Foreign Application Priority Data

May 18, 2000 (DE) ..... 100 24 505
Aug. 8, 2000 (EP) ..... 00116974

(51) Int. Cl.[7] ..... E21B 10/38

(52) U.S. Cl. ..... 175/296; 175/135; 173/200; 173/206

(58) Field of Search ..... 175/135, 296, 175/414; 299/100; 173/136, 138, 200, 90, 114, 206

(56) References Cited

U.S. PATENT DOCUMENTS 1,884,946 A * 10/1932 Wineman
2,041,690 A * 5/1936 Baumeister et al.
4,109,734 A * 8/1978 Montabert ..... 173/114
4,886,128 A * 12/1989 Roemer ..... 173/132
5,097,913 A * 3/1992 Gustafsson ..... 173/200
5,409,072 A * 4/1995 Enlund et al. ..... 175/135
5,520,254 A * 5/1996 Weber ..... 173/128
5,634,524 A * 6/1997 Campbell ..... 175/135
5,647,445 A * 7/1997 Puchala ..... 173/132
5,667,022 A * 9/1997 Gude ..... 173/105
6,273,199 B1 * 8/2001 Kiikka et al. ..... 173/1
6,334,495 B2 * 1/2002 Deimel et al. ..... 173/115
6,371,222 B1 * 4/2002 Andersson et al. ..... 173/136

FOREIGN PATENT DOCUMENTS

DE 43 43 589 C1 4/1995
EP 0112810 A2 * 7/1984
FR 2547347 A1 * 12/1984 ..... E21B/6/00

* cited by examiner

*Primary Examiner*—David Bagnell
*Assistant Examiner*—T. Shane Bomar
(74) *Attorney, Agent, or Firm*—Diller Ramik & Wight

(57) ABSTRACT

Two working pistons (AK1, AK2) strike on the anvil (10) of a drill device or a rock breaking device. One working piston (AK1) is a solid piston, while the other (AK2) is an annular piston. Both working pistons can work at the same or substantially the same rate. In general, the percussion rate acting on the anvil (10) can be doubled with two working pistons. The working pistons can be controlled in common or independent from each other. In a synchronous mode with equal phase, the impact energy is multiplied; in an asynchronous mode or a mode with opposite phases, the percussion rate is increased.

5 Claims, 6 Drawing Sheets

METHOD FOR PERFORMING GROUND OR ROCK WORK AND HYDRAULIC PERCUSSION DEVICE

BACKGROUND OF THE INVENTION

The present invention refers to a method for performing work in the ground or on rock, where impacts are dealt on an anvil by a hydraulically driven working piston, as well as to a hydraulic percussion device for performing such work in the ground or on rock.

The term work in the ground or on rock refers to drilling in the ground or in rock, in particular to impact drilling; among others, this also includes superposed drilling with an inner drill column and an outer drill column, as well as the operation of rock breaking devices wherein a working tool in the form of a chisel is driven into rock by percussion, so as to break the rock.

Hydraulic percussion devices are known that strike on the adapter end of a pipe column for drilling work or on the chisel of a rock breaking device. The efficiency of such a percussion device depends on the energy of the single impact and on the percussion rate. A high single impact energy is achieved if the working piston of the percussion device has a great mass. To accelerate such masses, high pressures are required. In practice, the mass of the working piston is several kilos and the piston stroke is 35 mm, for example. Typical piston rates are 7 to 11 m/sec. The achievable percussion rate is between 250 and 3,500 impacts/min. If the single impact energy is to be increased, it is common to increase the mass of the working piston, which, however, generally results in a decrease of the percussion rate.

From German Patent 43 43 589 C1, a fluid operated impact drill is known, wherein the working piston is controlled by a control piston and strikes on the adapter end of a drill column. In order to free the drill column when withdrawing the drill column, a back stroke piston is provided that strikes on a counter strike surface of the adapter end opposite the anvil. Here, the back stroke piston is activated only when the working piston is deactivated.

It is the object of the present invention to provide a method for performing ground or rock work and a hydraulic percussion device to achieve a higher efficiency of the percussion work, i.e. an increased drill advancement or a higher breaking efficiency (in rock breaking).

SUMMARY OF THE INVENTION

The present method and hydraulic percussion device provide for at least two working pistons striking in the same direction on an anvil. Thus, the anvil is acted upon by two working pistons, the impacts dealt by the working pistons preferably being offset in time. This results in an increased percussion rate without the single impact energy being lowered by a reduction of the piston mass.

Basically, the pistons are intended to strike the anvil at different times. The movements of the working pistons can be synchronized such that the working pistons are operated with mutually offset phases, so that two working pistons would be phase-shifted by 180°, for example. This means that one working piston performs the impact stroke while the other piston performs the return stroke. In another alternative, the two working pistons operate independent from each other and at different rates. Here, it is assumed that the impacts of the working pistons are normally offset in time and that the both working pistons happen to strike concurrently only at certain moments.

Another variant of the invention provides that the impacts from the working pistons are dealt synchronously, i.e. at the same time. In this case, the working pistons have to be operated at the same working rate and without mutual phase shift. It is also possible to provide a percussion device such that the working pistons can optionally be operated synchronously and asynchronously.

The invention provides for a high number of impacts (percussion rate), whereby the drill column is kept in constant movement (vibration) during drilling. Since most grounds contain an amount of grainy material that is caused to move by the high number of impacts, a very great drill feed is achieved in percussion drilling. Furthermore, the present method is adapted to prevent bouncing impacts that occur when an impact meets a shock wave traveling back along the drill column. Due to high number of impacts, the next impact is always performed already when the returning wave has not yet reached the rear end.

The present invention allows for numerous variants of control for the at least two working pistons. Both working pistons may be controlled separately and completely independent from each other. Alternatively, a control is conceivable where both working pistons are equal or a control, where one working piston functions as a master and the other functions as a slave.

In the context of the present invention, the impacts on the anvil are dealt by different working pistons. Preferably, the working pistons have substantially the same mass. That means that difference between the masses is 10% at most. However, the masses may differ more, yet the mass of the lighter working piston should not be less than two thirds, preferably not less than three quarters of the mass of the heavier working piston.

BRIEF DESCRIPTION OF THE DRAWINGS

The following is a description of the preferred embodiments of the present invention with reference to the accompanying drawings.

In the figures.

DETAILED DESCRIPTION OF PREFERRED EMBODIMENTS

Figure 1:
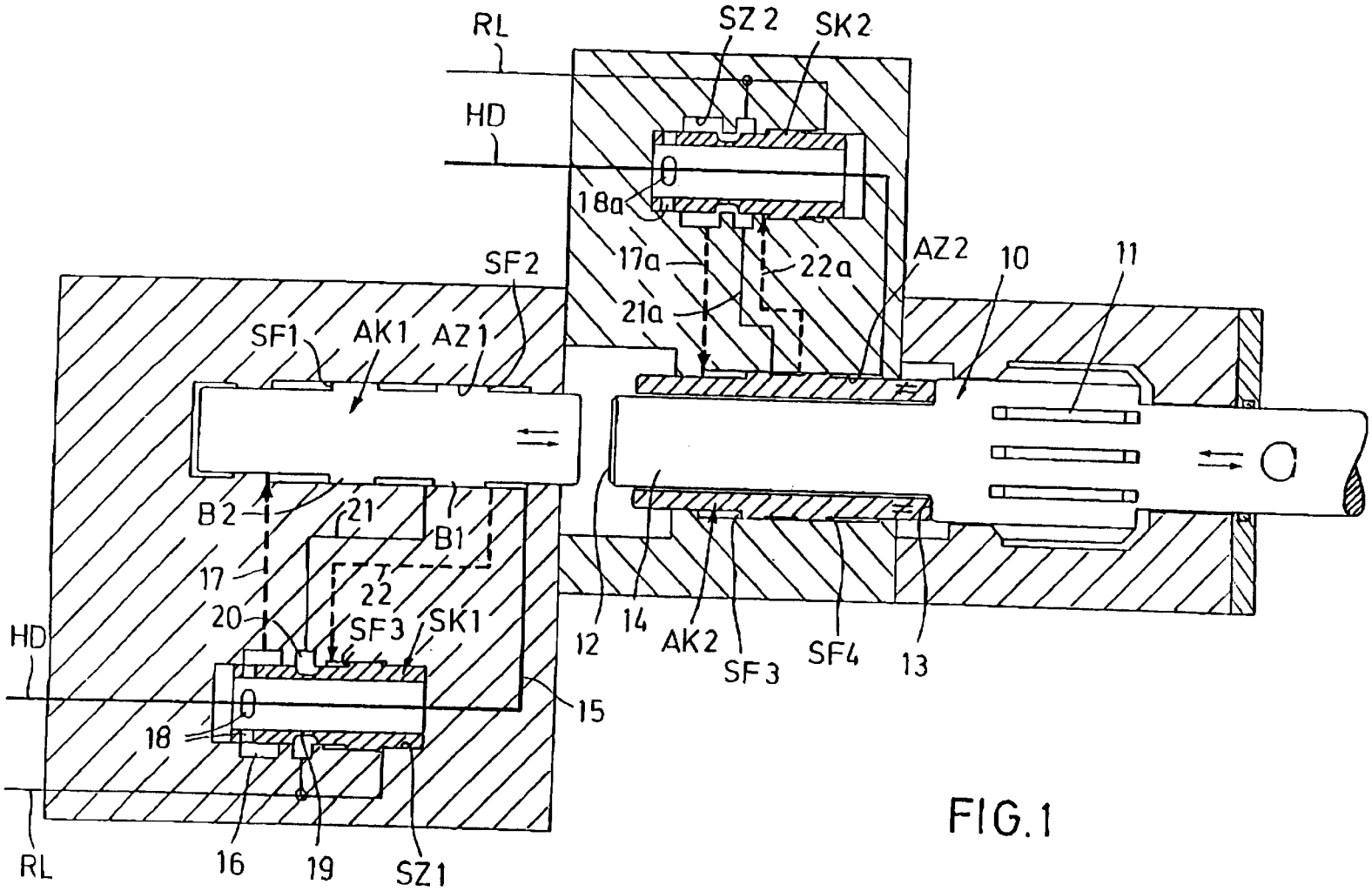
FIG. 1 is a schematic view of a first embodiment of the percussion device with independently controlled working pistons.

In all embodiments, the anvil 10 is the adapter end of a drilling device, the adapter end being connected to a drill column (not illustrated) having a drill bit at its front end. The inset end comprises a splined shaft section 11 engaged by a rotary drive (not illustrated) so as to rotate the inset end, whereby the drill column is also rotated.

At its front end, the anvil 10 has a first anvil surface 12 and a second anvil surface 13 spaced therefrom. A shaft 14 projects rearward from the anvil surface 13. The first anvil surface 12 is provided at the end of the shaft 14.

As illustrated in FIG. 1, the first anvil surface 12 is struck by a first working piston AK1 displaceable within a working cylinder AZ1. The working piston AK1 is controlled by a control piston SK1 displaceable within a control cylinder SZ1. The control piston SK1 is a hollow control sleeve, whereas the working piston AK1 is a solid piston.

The control cylinder SZ1 is traversed by a high pressure line HD through which a medium is supplied at high pressure. The hydraulic medium also fills the hollow interior of the control piston SK1, A high pressure line 15 leads from the control cylinder SZ1 to the front end of the working cylinder AZ1. The control cylinder SZ1 is provided with an annular groove 16 from which a control line 17 extends to the rear end of the working cylinder AZ1. The annular groove 16 is alternately communicated with the high pressure via radial bores 18 in the control piston SK1 and with the return passage RL via a control groove 19 on the outer surface of the working piston SK1. The control groove 19 is constantly within the area of an annular groove 20 of the control cylinder SZ1 connected with the return passage RL. A return line 21 extends from the working cylinder AZ1 to the annular groove 20.

Further, a control line 22 extends from the working cylinder AZ1 to the control cylinder SZ1. The control line 22 is connected to the high pressure line 15 when the working piston AK1 is in the retracted position (illustrated in FIG. 1), and it is connected with the return line 21, when the working piston AK1 is in the forward end position striking the anvil surface 12. This switching of the control piston by the working piston is effected by a collar B1 of the working piston. Another collar B2 of the working piston defines the rear cylinder space into which the control line 17 leads, The drive of the working piston AK1 in a forward working stroke is effected by high pressure acting on the control surface SF1 via the control line 17. The control surface SF2 opposite the control surface SF1 is smaller than the control surface SF1. The control surface SF2 is constantly subjected to high pressure. During the return stroke, the control surface SF1 is not pressurized so that the working piston AK1 is moved backward. In the working stroke, the force exerted on the larger control surface SF1 outweighs the counter force exerted on the smaller control surface SF2.

The control line 22 controls the movement of the control piston SK1 by exerting its pressure on the control surface SF3. The control piston SK1 is hydraulically biased to the left, that is into the position corresponding to the return stroke of the working piston AK1. If, however, high pressure acts on the control surface SF3 via the control line 22, the control piston SK1 is shifted to the represented (right-hand) position, in which it causes the working or impact stroke of the working piston AK1.

The device described above is known. According to the present invention, an additional second working piston AK2 is provided that is hollow or tubular and strikes the annular anvil surface 13. The outer surface of the working piston AK2 is basically of the same design as that of the working piston AK1. It comprises two opposite control surfaces SF3 and SF4, the control surface SF4 being constantly exposed to high pressure, whereas the pressure acting on the control surface SF3 is changed by the control piston SK2. The control piston SK2 controls the working piston AK2 via the control line 17*a* and the working piston AK2 controls the control piston SK2 via the control line 22*a*. The control piston SK2 is designed the same as the control piston SKi. It is also connected to the high pressure line HD and the return line RL.

The masses of both control pistons AK1 and AK2 are approximately equal. The mass of each piston is between 8 and 30 kg. The piston stroke of the working pistons is about 35 mm and the working rate of the working pistons is up to 3,500 impacts per minute.

In the embodiment of FIG. 1, each working piston has its own control piston. The movements of the working pistons are therefore not synchronized. Since it is not likely that both working pistons are operated with exactly the same rate, irregular impact sequences are obtained.

The two high pressure lines HD in FIG. 1 may either be connected to the same high pressure source or to different high pressure sources. Thus, it is possible to operate both working pistons and the associated control pistons with different pressure values. The different pressure sources can also be designed for different amounts of oil.

Figure 2:
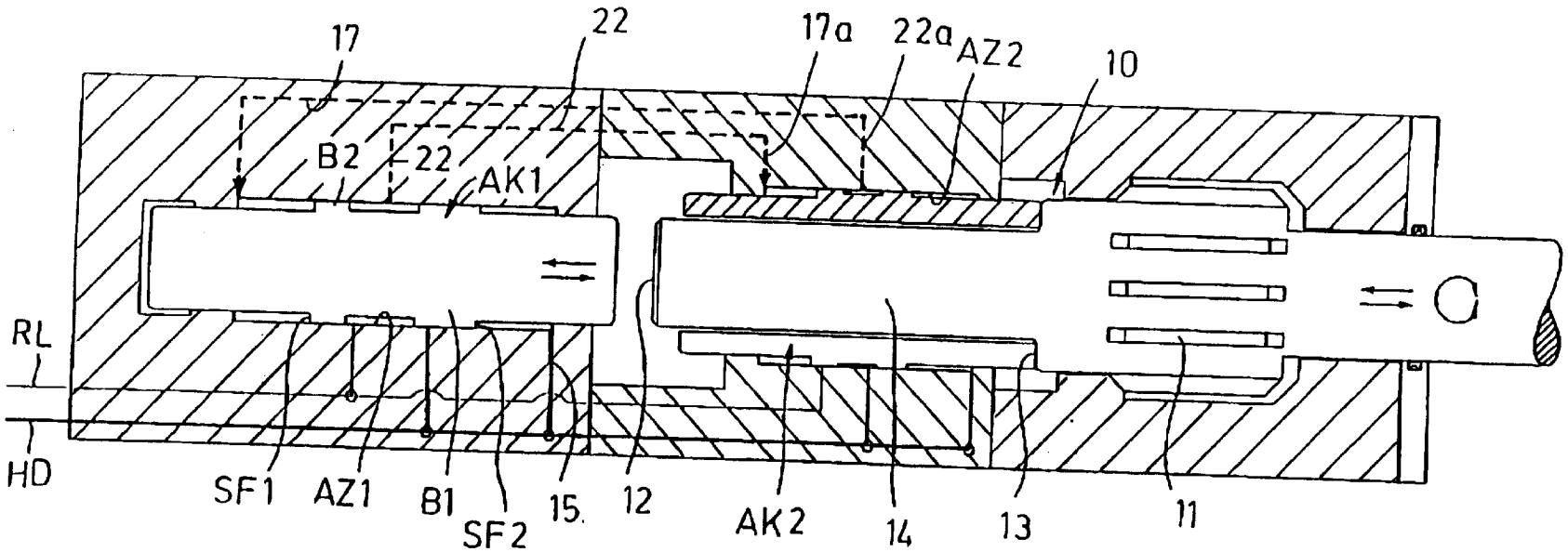
FIG. 2 illustrates an embodiment, where the working pistons control each other.

In the embodiment of FIG. 2, the working piston AK1 and the working cylinder AZ1 are designed in the same manner as in the first embodiment. The working piston AK1 strikes the anvil surface 12 of the anvil 10. The working piston AK2 and the working cylinder AZ2 are also designed as in the first embodiment. The working piston AK2 is an annular piston striking the annular anvil surface 13. In this embodiment, no separate control piston is provided, since the working piston AK2 forms the control piston of the working piston AKi, and vice versa. The control line 17 of the first working cylinder AZ1 is connected with the control line 22*a* of the first working cylinder AZ1 and the control line 22 of the first working cylinder AZ1 is connected with the control line 17*a* of the second working cylinder AZ2. The working pistons control each other and in opposite phase. This means that the working piston AK2 takes its front position when the working piston AK1 assumes its rear end position, and that the working piston AK2 assumes its rear end position, when the working piston AK1 takes its front end position. The movements of both working pistons are synchronized and phase-shifted by 180°. Thus, with a regular impact cycle, an impact rate is obtained that is twice the impact rate of each single working piston.

Figure 3:
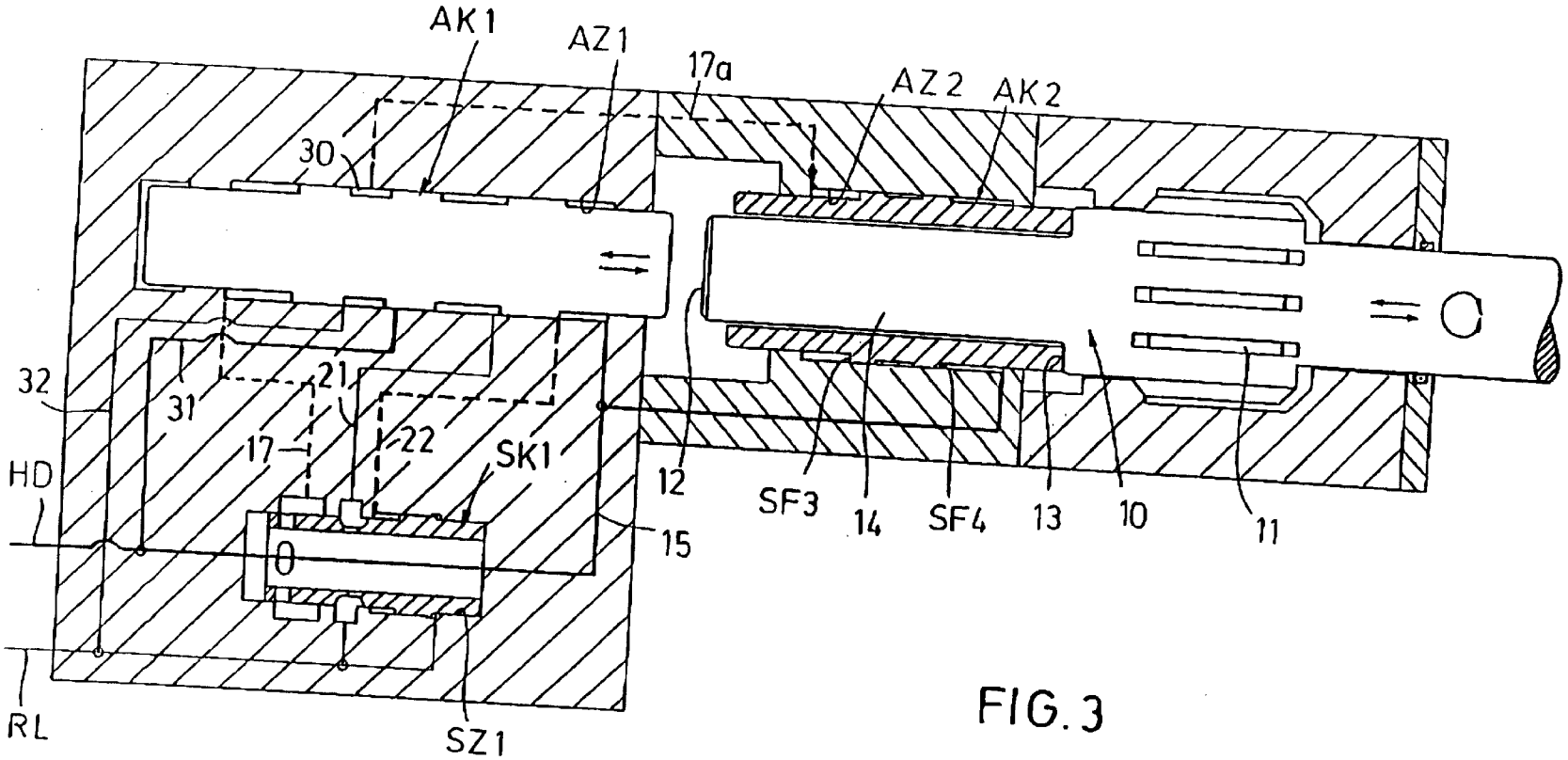
FIG. 3 illustrates an embodiment, where one working piston cooperates with one control piston, thereby controlling the other working piston.

In the embodiment of FIG. 3, the working piston AK1 is designed in the same manner as in the other embodiments, but with an additional control groove 30 provided which, depending on the position of the working piston, is either communicated with a pressure line 31 or with a return line 32. By switching or exchanging the lines 31, 32, the phase position of the working piston AK2 can be reversed with respect to the working piston AK1. On the other hand, interrupting or blocking the pressure line 31 allows to deactivate the working piston AK2. It is also possible to connect the line 31 to a separate (different) high pressure source. In this manner, the working piston AK2 can be operated with another pressure source, as is true for the working piston AK1 and the control piston SK1. It is also possible that the other pressure source supplies a different amount of oil per unit time. The possibility to operate the working pistons with separate pressure sources increases the versatility of the percussion device. From the area of the control groove 30 a control line 17*a* leads out of the working cylinder AZ1. This control line extends into the working cylinder AZ2 to pressurize or to de-pressurize the control surface SF3 of the working piston AK2. In this embodiment, the working piston AK1, together with the control piston SK1, again forms a feedback circuit determining the rate, whereas the working piston AK2 is controlled as a slave by the working piston AK1.

Figure 4:
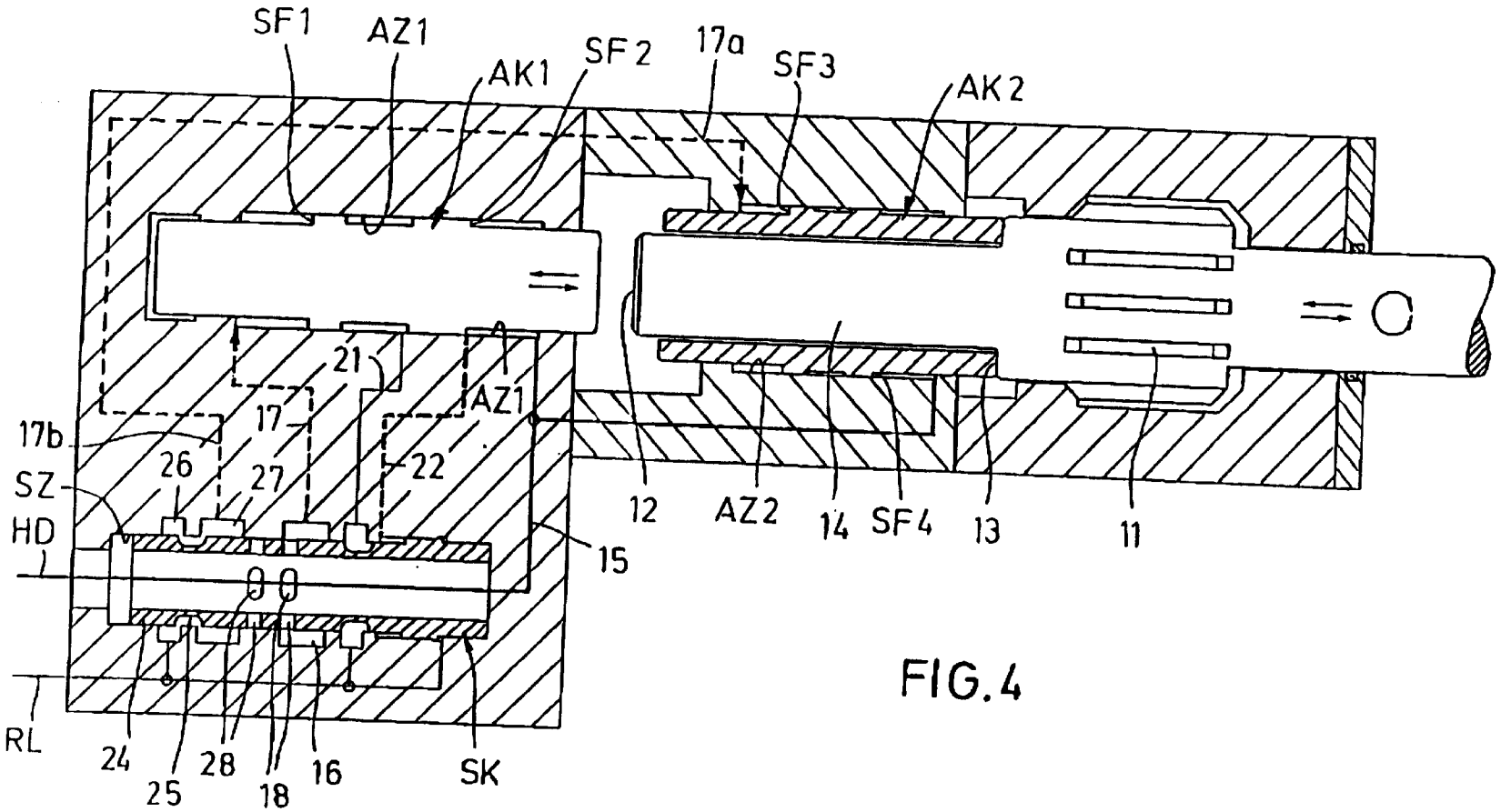
FIG. 4 illustrates an embodiment, where one working piston cooperates with a control piston, while the control piston simultaneously controls the other working piston, FIG. 5 an embodiment similar to FIG. 4 but with a switching element added, with which one of several modes may be selected, one of the modes being illustrated in FIG. 5, FIG. 6 the switching element of FIG. 5 in a second mode, and FIG. 7 the switching element of FIG. 5 in a third mode.

In the embodiment of FIG. 4, a control sleeve SK controls the first working piston AK1 in the same manner as in the embodiment of FIG. 1. The control piston SK is designed the same as the control piston SK1, but is provided with an extension 24. The extension 24 comprises a control groove 25 that can bridge two annular grooves 26, 27 of the control cylinder SZ. The annular groove 26 is constantly connected with the return line RL and the annular groove 27 is connected with a control line 17*b*, which is in turn connected with the control line 17*a* leading into the working cylinder AZ2. The control line 17*b* is alternately pressurized through radial bores 28 in the control piston SK and de-pressurized through the control groove 25. The pressure in the control line 17*b* is in opposite phase to the pressure in the control line 17, whereby both working pistons AK1 and AK2 are operated in opposite phases. The working piston AK1 cooperates with the control piston SK to generate an oscillating movement, whereas the operating piston AK2 is merely controlled as a slave but has no influence on the control.

As an alternative to the embodiment described in FIG. 3, it is also possible to operate the working piston AK2 in phase with the working piston AK1. To this end, the control line 17*b* must be blocked and the control line 17 must be connected with the control line 17*a*. In a synchronous operation with the same phase, the percussion rate is relatively low, but the single impact energy is all the higher.

It is also possible to switch between both modes, for example, to break rock with low-rate impacts of high single impact energy, and to work with a high percussion rate and low single impact energy in normal ground.

Figure 5:
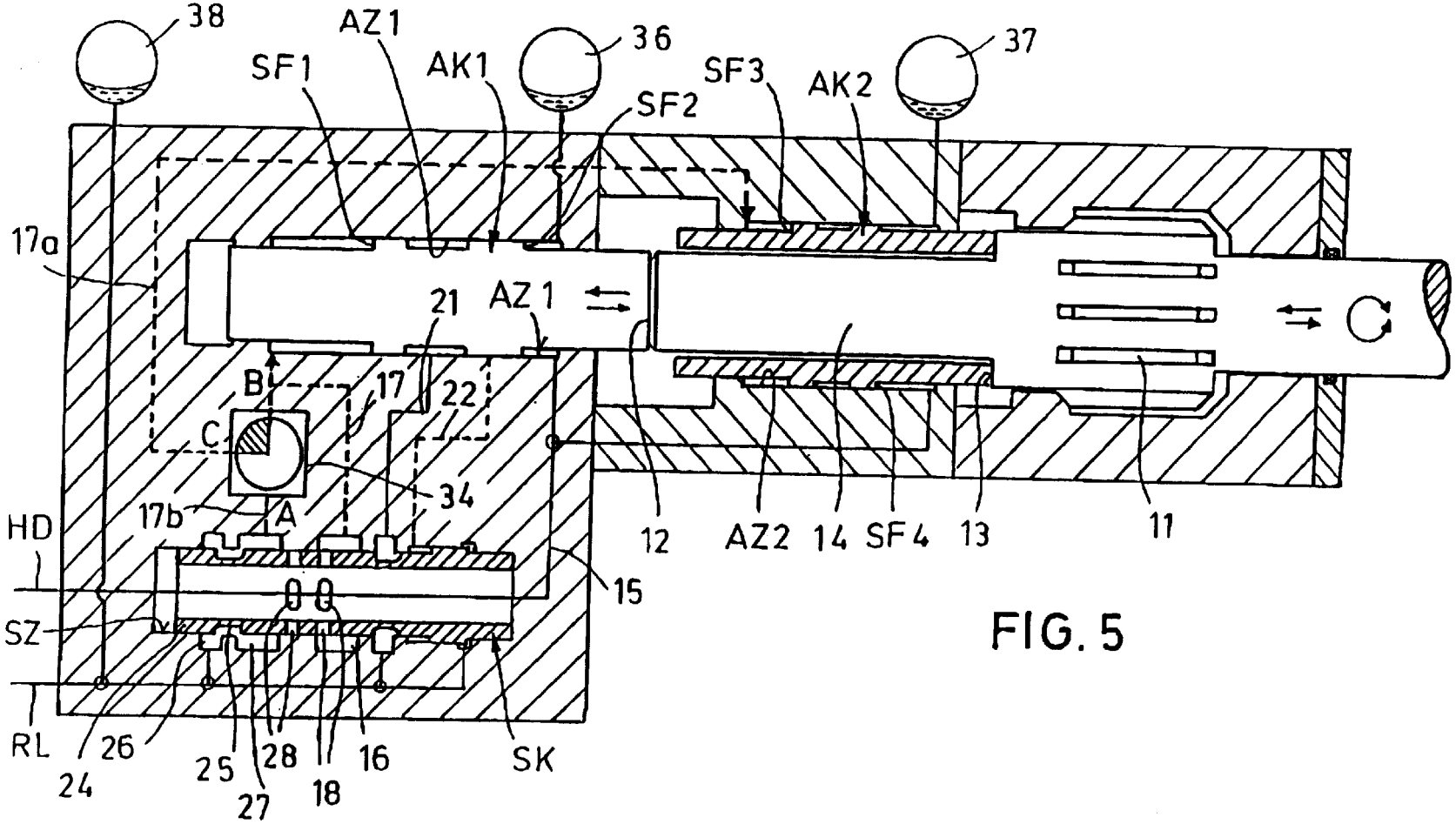

The embodiment of FIG. 5 largely corresponds to that of FIG. 4 so that the following description is restricted to the explanation of the differences.

According to FIG. 5, the control lines 17, 17*a* and 17*b* are connected to a switching element 34 which is a directional control valve. The switching element has three ports A, B, C, where C is an outlet that can selectively be connected to the inlet A or the inlet B, or be de-pressurized.

In FIG. 5, the switching element 34 is in the position in which it connects the inlet B with the outlet C. The inlet A is blocked. This means that the control pressure in the control line 17 controls both the working piston AK1 and the working piston AK2, this control being synchronous. Both working pistons thus strike the shaft 14 together and at the same time.

Figure 6:
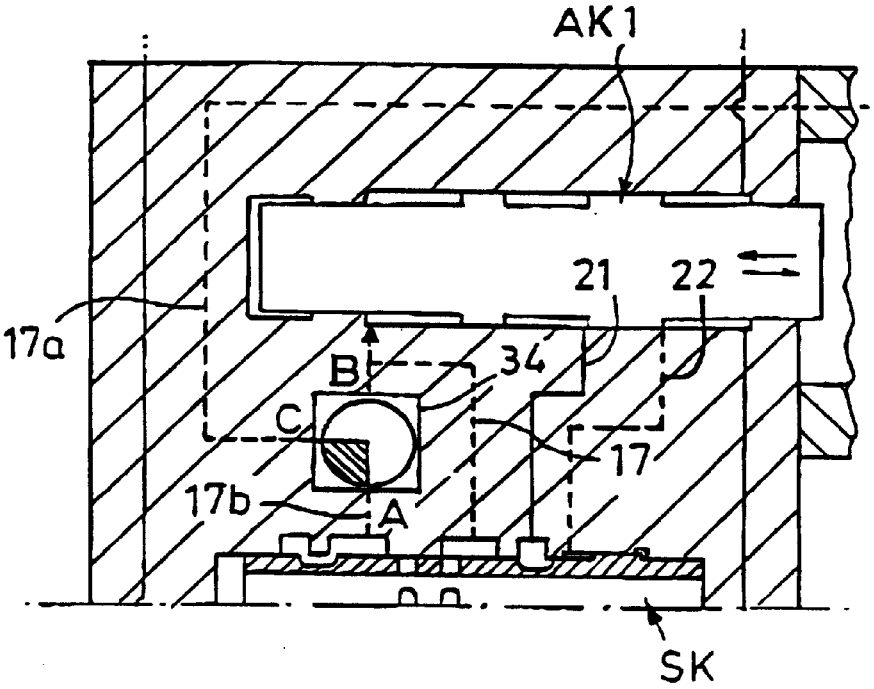

When the switching element 34 is in the position illustrated in FIG. 6, it connects the inlet A with the outlet C. The inlet B is blocked. Since the control lines 17, 17*b* have inverse pressures, the two working pistons AK1 and AK2 are operated in opposite phases. The percussion rate is thus twice that of a single working piston.

Figure 7:
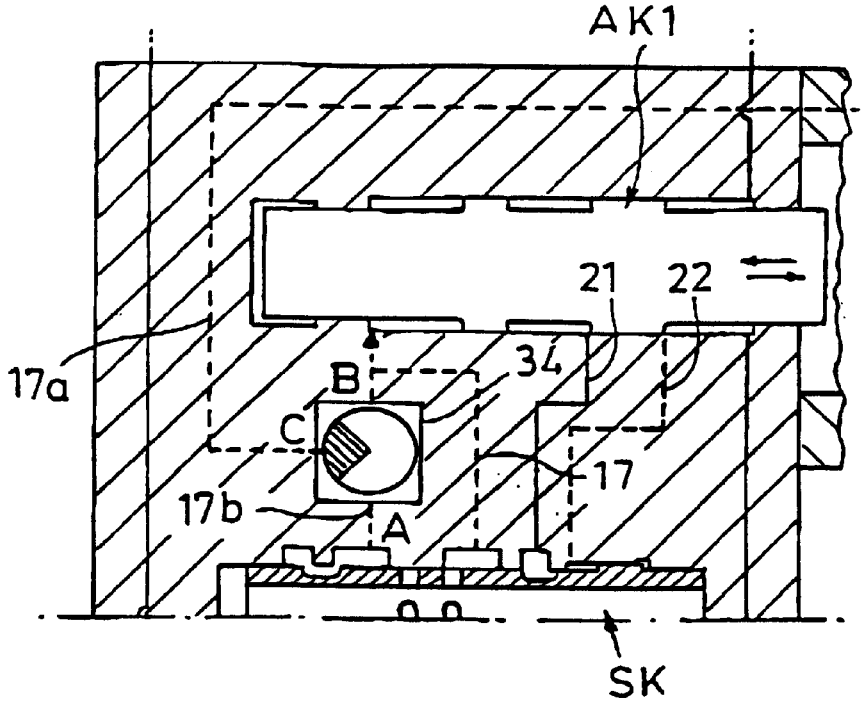

In the position of the switching element 34 illustrated in FIG. 7, the inlets A and B of the switching element are blocked, while the outlet C is connected to the return line. Thus, the control line 17*a* is de-pressurized and the working piston AK2 is deactivated. Only the working piston AK1 is operative due to the control through the control line 17.

As illustrated in FIG. 5, the pressure lines 15 that lead into both working cylinders AZ1 and AZ2 are each connected to an own gas pressure storage means 36 an 37, respectively, so that the working pistons do not take each others pressure. Moreover, the return line RL is connected to a gas pressure storage means 38.

I claim:

1. A method for performing ground or rock work wherein impacts are exerted on an anvil (10) by impacts exerted in the same direction on the anvil (10) using at least two substantially simultaneously hydraulically operated working pistons (AK1, AK2), and cooperatively independently hydraulically controlling (SK1, SK2) the at least two substantially simultaneously hydraulically operated working pistons (AK1, AK2) to effect working piston impacts in the same direction.

2. The method of claim 1, wherein the working pistons (AK1, AK2) are operated at substantially equal percussion rates.

3. A hydraulic percussion device for ground work and rock work comprising at least two substantially simultaneously hydraulically operated working pistons (AK1, AK2) for exerting impacts in the same direction on an anvil (10) connected to a working tool, and hydraulic control means (SK1, SK2) for cooperatively independently hydraulically controlling the operation of said at least two working pistons (AK1, AK2) to effect working piston impacts in the same direction.

4. The percussion device of claim 3, wherein the masses of the working pistons (AK1, AK2) are substantially equal.

5. The percussion device of claim 3, wherein the mass of one working piston is substantially within the range of 65% to 75% of the mass of the other working piston.

* * * * *